US010593508B2

(12) United States Patent
Ueki et al.

(10) Patent No.: US 10,593,508 B2
(45) Date of Patent: Mar. 17, 2020

(54) EMITTER INCLUDING A ZIGZAG CURRENT PATH AND RIB PORTIONS, AND X-RAY TUBE

(71) Applicant: Canon Electron Tubes & Devices Co., Ltd., Otawara-shi (JP)

(72) Inventors: Masataka Ueki, Nasushiobara (JP); Masahiko Tezuka, Otawara (JP)

(73) Assignee: Canon Electron Tubes & Devices Co., Ltd., Otawara-shi (JP)

( * ) Notice: Subject to any disclaimer, the term of this patent is extended or adjusted under 35 U.S.C. 154(b) by 280 days.

(21) Appl. No.: 15/473,888

(22) Filed: Mar. 30, 2017

(65) Prior Publication Data

US 2017/0287670 A1 Oct. 5, 2017

(30) Foreign Application Priority Data

Apr. 1, 2016 (JP) ..... 2016-074377

(51) Int. Cl.
*H01J 35/06* (2006.01)
*H01J 35/10* (2006.01)

(52) U.S. Cl.
CPC ..... *H01J 35/064* (2019.05); *H01J 35/06* (2013.01); *H01J 35/10* (2013.01)

(58) Field of Classification Search
CPC ..... H01J 35/06; H01J 35/02; H01J 35/025; H01J 35/064
USPC ..... 378/136
See application file for complete search history.

(56) References Cited

U.S. PATENT DOCUMENTS 6,115,453 A * 9/2000 Hell ..... H01J 1/16 378/113
6,426,587 B1 * 7/2002 Hell ..... H01J 1/16 313/341
6,646,366 B2 * 11/2003 Hell ..... H01J 1/16 313/310
7,516,528 B2 * 4/2009 Lemarchand ..... H01J 9/04 264/309
7,693,265 B2 * 4/2010 Hauttmann ..... H01J 35/06 378/136
7,864,925 B2 * 1/2011 Kutschera ..... H01J 35/06 313/348
7,903,788 B2 * 3/2011 Moore ..... H01J 35/06 378/121

(Continued)

FOREIGN PATENT DOCUMENTS

JP S52-155957 A 12/1977
JP 2012-15045 A 1/2012

(Continued)

OTHER PUBLICATIONS

Office Action dated Dec. 17, 2019, in corresponding Japanese Patent Application No. 2016-074377 with English translation.

*Primary Examiner* — Allen C. Ho
(74) *Attorney, Agent, or Firm* — Oblon, McClelland, Maier & Neustadt, L.L.P.

(57) ABSTRACT

According to one embodiment, an emitter comprise a base portion including an electron emission surface from which electrons are emitted, a pair of leg portions applying a voltage to the electron emission surface, and a rib portion formed by bending an edge of the base portion to a side opposite to the electron emission surface, on at least a part of an outline of the electron emission surface.

12 Claims, 4 Drawing Sheets

(56) References Cited

U.S. PATENT DOCUMENTS

| | | | | |
|---|---|---|---|---|
| 7,924,983 | B2 * | 4/2011 | Moore | H01J 1/15 378/122 |
| 8,000,449 | B2 * | 8/2011 | Hauttmann | H01J 35/06 313/310 |
| 8,027,433 | B2 * | 9/2011 | Zou | H01J 35/06 313/447 |
| 8,077,829 | B2 * | 12/2011 | Moore | H01J 1/20 378/136 |
| 8,183,756 | B2 * | 5/2012 | Terletska | H01J 1/13 313/310 |
| 8,247,971 | B1 * | 8/2012 | Bard | H01J 1/16 313/310 |
| 8,254,526 | B2 * | 8/2012 | Hauttmann | H01J 35/06 378/136 |
| 8,294,350 | B2 * | 10/2012 | Freudenberger | H01J 1/16 313/341 |
| 8,385,506 | B2 * | 2/2013 | Lemaitre | H01J 1/20 378/136 |
| 8,548,124 | B2 * | 10/2013 | Hauttmann | H01J 35/14 378/136 |
| 8,831,178 | B2 * | 9/2014 | Lemaitre | H01J 35/06 378/136 |
| 9,202,663 | B2 * | 12/2015 | Yoshizawa | H01J 35/06 |
| 9,251,987 | B2 * | 2/2016 | Zhang | H01J 35/06 |
| 9,443,691 | B2 * | 9/2016 | Robinson | H01L 23/367 |
| 9,466,455 | B2 * | 10/2016 | Hubbard | H01J 35/06 |
| 9,472,371 | B2 * | 10/2016 | Virshup | H01J 35/06 |
| 9,530,603 | B1 * | 12/2016 | Kobayashi | H01J 35/06 |
| 9,653,248 | B2 * | 5/2017 | Ishihara | H01J 35/06 |
| 9,659,741 | B2 * | 5/2017 | Canfield | H01J 35/06 |
| 9,711,320 | B2 * | 7/2017 | Zou | H01J 35/065 |
| 9,711,321 | B2 * | 7/2017 | Lemaitre | H01J 35/06 |
| 9,824,843 | B2 * | 11/2017 | Riedl | H01J 35/06 |
| 9,826,613 | B2 * | 11/2017 | Tomita | H05G 1/34 |
| 9,887,061 | B2 * | 2/2018 | Kobayashi | H01J 35/06 |
| 9,928,985 | B2 * | 3/2018 | Lemaitre | H01J 35/06 |
| 9,928,986 | B2 * | 3/2018 | Riedl | H01J 35/06 |
| 9,953,797 | B2 * | 4/2018 | Zhang | H01J 35/06 |
| 10,032,595 | B2 * | 7/2018 | Lamaitre | H01J 35/06 |
| 10,109,450 | B2 * | 10/2018 | Virshup | H01J 35/06 |
| 10,111,311 | B2 * | 10/2018 | Koga | H01J 35/06 |
| 10,121,628 | B2 * | 11/2018 | Koga | H01J 35/06 |

FOREIGN PATENT DOCUMENTS

| | | |
|---|---|---|
| JP | 2014-232629 | 12/2014 |
| JP | 2019-509604 A | 4/2019 |
| WO | WO 2017/161161 A1 | 9/2017 |

* cited by examiner

EMITTER INCLUDING A ZIGZAG CURRENT PATH AND RIB PORTIONS, AND X-RAY TUBE

CROSS-REFERENCE TO RELATED APPLICATIONS

This application is based upon and claims the benefit of priority from Japanese Patent Application No. 2016-074377, filed Apr. 1, 2016, the entire contents of which are incorporated herein by reference.

FIELD

Embodiments described herein relate generally to a thermoelectron emitter and an X-ray tube.

BACKGROUND

An emitter comprising both a base portion including an electron emission surface from which thermoelectrons are emitted and a pair of leg portions that apply a voltage to the electron emission surface has been publicly known.

The conventional emitter has a problem in reliability for the reason that since the temperature of the electron emission surface is increased, deformation occurs due to thermal stress, and risks in strength reduction, abnormality of electron emission property and the like are thereby increased.

DETAILED DESCRIPTION

In general, according to one embodiment, an emitter comprises: a base portion including an electron emission surface from which electrons are emitted; a pair of leg portions applying a voltage to the electron emission surface; and a rib portion formed by bending an edge of the base portion to a side opposite to the electron emission surface, on at least a part of an outline of the electron emission surface.

An X-ray tube 1 of the embodiments will be hereinafter explained and the X-ray tube 1 of the first embodiment will be explained with reference to FIG. 1 and FIG. 2.

Figure 2:
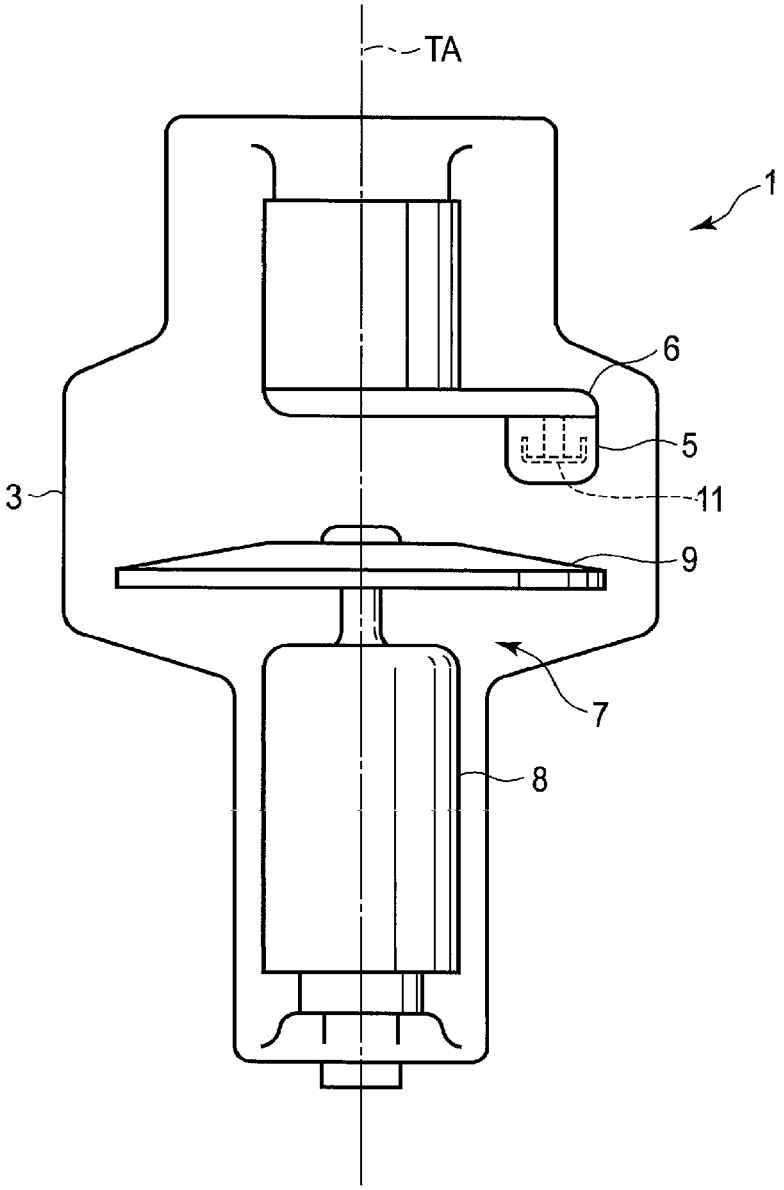
FIG. 2 is a front view showing a schematic structure of an X-ray tube using the emitter of the first embodiment.

As shown in FIG. 2, the X-ray tube 1 comprises an vacuum envelope 3, a cathode 5 which is provided in the vacuum envelope 3 to emit electrons, and an anode 7 which is provided in the vacuum envelope 3 and with which the electrons emitted from the cathode 5 collide to generate X rays. The X-ray tube 1 is a rotary anode type X-ray tube, and an anode target 9 is rotated about a rotary axis TA by a rotation mechanism 8 in the anode 7. The cathode 5, which is supported by a cathode support 6, emits an electron beam (electrons) which converges at a high voltage onto an anode target 9, and an emitter 11 is provided in the cathode 5.

Figure 1:
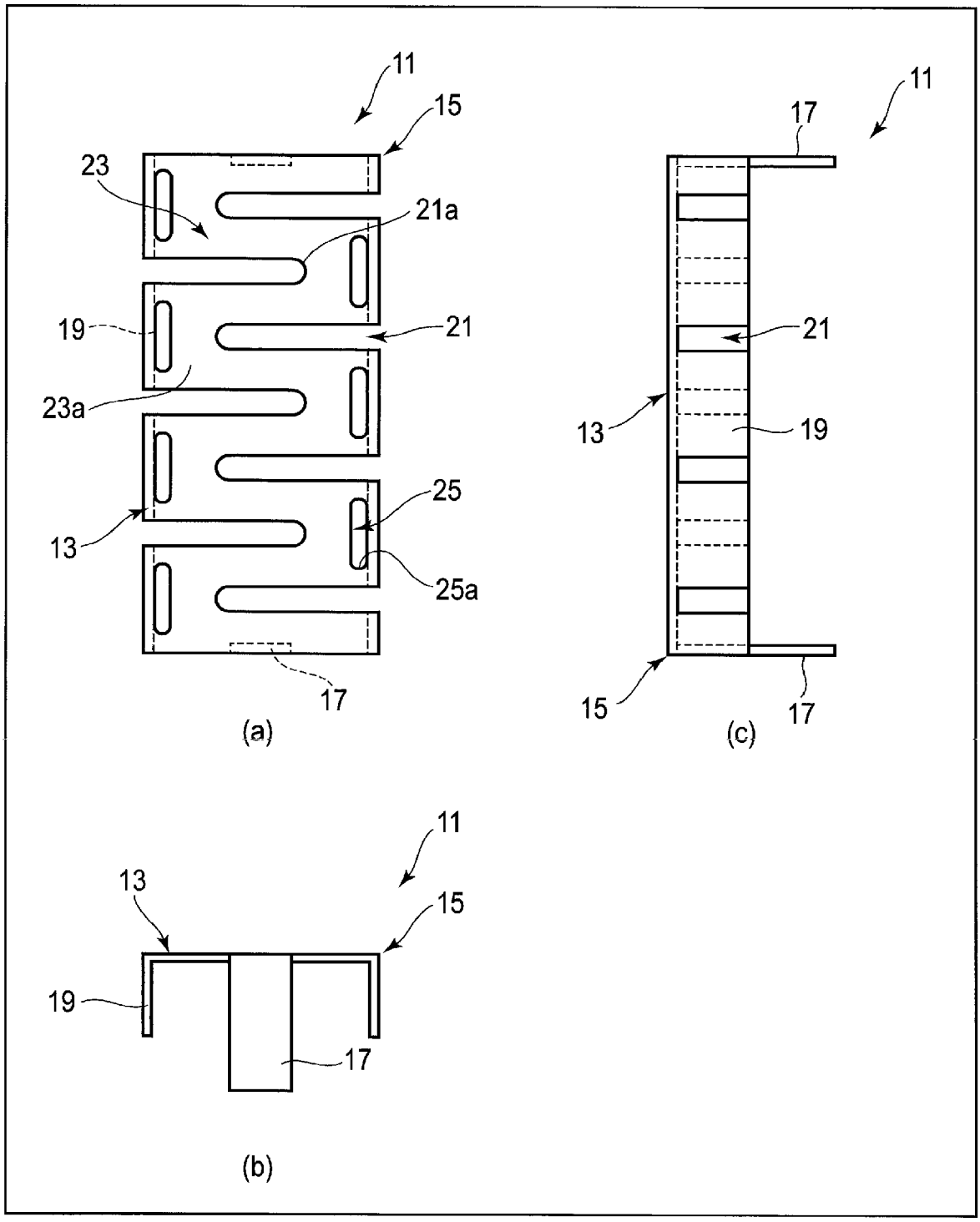
FIG. 1 illustrates an emitter of a first embodiment; (a) is a plan view, (b) is a front view and (c) is a side view.

As shown in FIG. 1, the emitter 11 comprises a base portion 15 including an electron emission surface 13 from which the electrons are emitted, a pair of leg portions 17, 17 that apply the voltage to the electron emission surface 13, and rib portions 19 formed by bending edges of the base portion 15 to a side opposite to the electron emission surface 13.

The base portion 15 is a plate having a thickness of up to 1 mm, formed of a metal which has high melting point and a low steam pressure in vacuum, for example, tungsten or an alloy containing tungsten as its major component. The electron emission surface 13 is designed as a flat surface formed in an approximately rectangular shape as a whole. The base portion 15 has a thickness of, for example, 0.2 to 0.6 mm in one embodiment.

The pair of leg portions 17, 17 are provided to protrude from opposed short sides of the electron emission surface 13 formed in an approximately rectangular shape toward a side opposite to the electron emission surface 13.

The rib portions 19 are formed by bending the edges of the base portion 15 to the side opposite to the electron emission surface 13, on opposed long sides (right and left sides between the leg portions 17, 17) on the electron emission surface 13 formed in an approximately rectangular shape as a whole. In the present embodiment, the rib portions 19 are bent at an angle of 90 degrees to a side opposite to the electron emission surface 13. The rib portions 19 are divided by slits 21 to be explained and spaced apart in a longitudinal direction of long sides.

The slits 21 are formed on the electron emission surface 13 to form a zigzag current path 23. The slits 21 are formed to be orthogonal to the opposed long sides of the electron emission surface 13, on the right and left sides, alternately, and to divide the rib portions 19. Thus, the zigzag current path 23 in a continuously zigzag shape is formed and the rib portions 19 are located at reverse portions 23*a* at which the zigzag current path 23 is reversed. A tip 21*a* of each slit 21 is formed in an arc shape.

Through holes 25 are formed at the reverse portions 23*a*. The through holes 25 are formed at positions close to the rib portions 19 at the reverse portions 23*a*. The through holes 25 are designed as long holes extending along the long sides of the electron emission surface 13. Longitudinal ends 25*a* of the through holes 25 are formed in an arc shape.

The actions and effects of the emitter 11 of the first embodiment will be hereinafter described.

As shown in FIG. 1, if a voltage is applied between the leg portions 17 and 17, in the emitter 11 of the first embodiment, Joule heat is generated on the electron emission surface 13 by the current flowing in the current zigzag path 23, and thermoelectrons are emitted from the electron emission surface 13.

Since the zigzag current path 23 is formed on the electron emission surface 13 by the slits 21, sufficient heat can be obtained even by a low current.

In general, the electron emission surface 13 may be heated to a high temperature (for example, 2400° C. to 2700° C.) by the Joule heat and deformed due to thermal expansion. In particular, a thermal stress may be repeatedly generated in the electron emission surface 13 by repetition of temperature rise resulting from energization and cooling, and a fatigue failure in the electron emission surface 13 may occur. In addition, deformation and bending of the electron emission surface 13 may occur due to shortage of strength, an appropriate space between a converging electrode (not shown) and the electron emission surface 13 may be varied, and the electrons emitted from the electron emission surface 13 may not be converged in an intended shape.

In contrast, since the rib portions 19 are provided in the emitter 11 of the present embodiment, the strength of the entire emitter 11 can be increased and the deformation caused by the thermal stress can be reduced. In particular, the shape of the base portion 15 can be maintained, and the problems that the X-ray focal dimension may be out of standards by the deformation due to the thermal stress and the electron distribution may be varied during use can be reduced. Furthermore, since the present embodiment can prevent the emitter 11 from being broken or the emitter 11 from contacting the converging electrode to make the electron emission property abnormal due to vibration and impulse caused by shortage of strength, the high-reliability emitter 11 and X-ray tube 1 can be provided by the present embodiment.

Since the rib portions 19 are formed by bending the base portion 15 to the side opposite to the electron emission surface 13, the end surfaces of the electron emission surface 13 do not face the anode side, and discharging can be prevented by suppressing unintentional cold emission of electrons from the end surfaces.

Since the through holes 25 are formed on the electron emission surface 13, thermal resistance and electric resistance of the electron emission surface 13 and the rib portions 19 can be controlled, increasing the current value to raise the temperature to a necessary value which is caused by the heat or electric current escaping from the electron emission surface 13 to the rib portions 19 can be suppressed, and consuming unnecessary power at the rib portions 19 which do not contribute to the electron emission can be suppressed.

Since the electric resistance of the current flow to the rib portions 19 is raised by the through holes 25, much current does not flow to the rib portions 19, and since the heat can hardly be transmitted from the electron emission surface 13 to the rib portions 19, the temperature of the rib portions 19 can hardly rise. For this reason, a thermal deformation amount of the emitter 11 can be reduced, deforming the entire emitter 11 in an arcuate shape due to thermal expansion can be suppressed, and varying the distribution of the electron beam converged onto the anode target 9 due to thermal transformation of the space between the converging electrode and the electron emission surface 13 can be suppressed.

In addition, the strength of the entire emitter 11 can be maintained and the entire emitter 11 can be prevented from being broken and damaged by vibration and impulse, by holding the electron emission surface 13, in which crystal can easily become brittle due to the temperature rise caused by voltage application, from the side surfaces by the rib portions 19.

The emitter 11 of the present embodiment can easily be produced at low costs by press molding or the like since the rib portions 19 are merely formed by bending the edges of the base portion 15 and the linearly shaped slits 21 are merely formed on the electron emission surface 13 shaped in a rectangle in planar view.

The other embodiments will be hereinafter explained, but portions having the same advantages as those of the above-explained embodiment will be denoted by the same reference numerals and detailed descriptions will be omitted, and points different from the above-explained embodiment will be mainly described in the following explanations.

Figure 3:
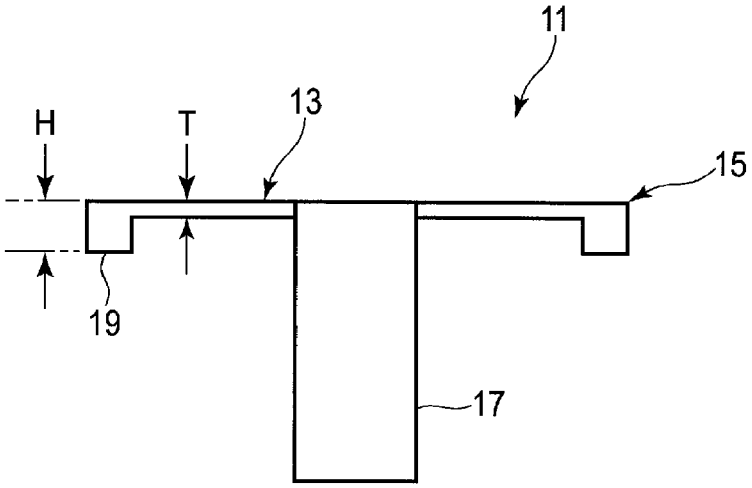
FIG. 3 is a front view showing an emitter of a second embodiment.

FIG. 3 shows an emitter 11 of a second embodiment. In the second embodiment, rib portions 19 at outline portions (edge portions) of an electron emission surface 13 protrude to a side opposite to the electron emission surface 13 from a base portion 15 and have a thickness H greater than a thickness T on the inner side of the outline. The other constituent elements are the same as those of the first embodiment.

The rib portions 19 are formed of the same material as the base portion 15 including the electron emission surface 13 and formed by increasing the thickness H of the edge portions of the electron emission surface 13.

According to the second embodiment, the same advantages as those of the first embodiment can be obtained since the rib portions 19 enable the strength of the emitter 11 to be increased, similarly to the first embodiment.

Furthermore, since the rib portions 19 are formed by merely increasing the thickness at the edges of the base portion 15, the rib portions 15 can easily be produced as compared with the first embodiment in which the rib portions 15 are formed by bending.

Figure 4:
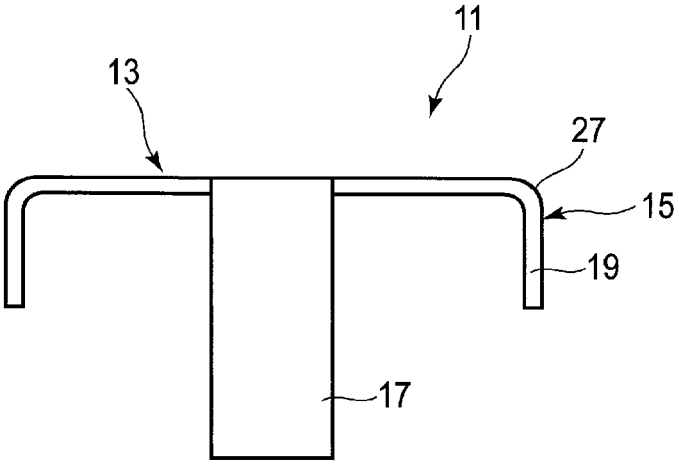
FIG. 4 is a front view showing an emitter of a third embodiment.

FIG. 4 shows an emitter 11 of a third embodiment. In the third embodiment, rib portions 19 are formed by bending edges of a base portion 15 to a side opposite to an electron emission surface 13, and bent portions are regarded as curved portions 27. The other constituent elements are the same as those of the first embodiment.

According to the third embodiment, the same advantages as those of the first embodiment can be obtained, and discharge from the bent portions can be suppressed since portions between the rib portions 19 and the electron emission surface 13 are curved by curved portions 27 and corners are not formed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Figure 5:
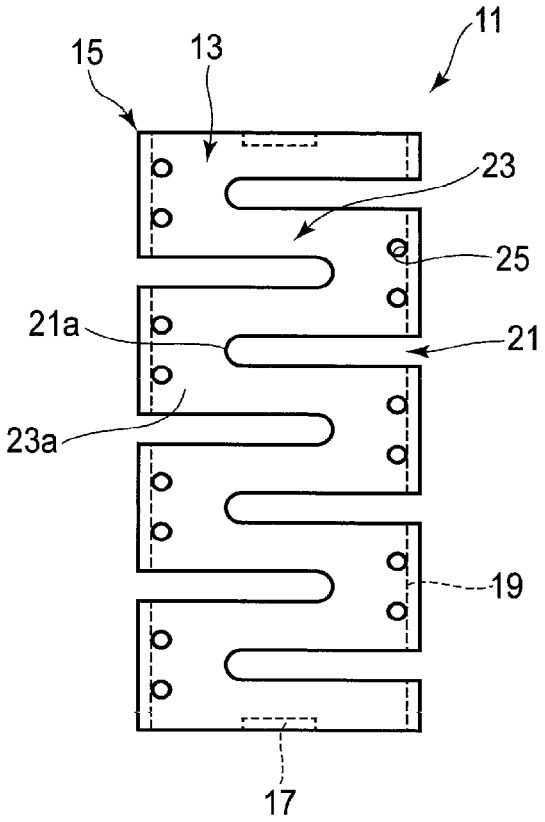
FIG. 5 is a plan view showing an emitter of a modified example.

For example, in the first to third embodiments, the shape of the through holes 25 is not limited but the shape may be round or a plurality of holes may be formed at the reverse portions 23*a* as shown in FIG. 5.

In the first to third embodiments, the rib portions 19 may be entirely in a curved shape. In addition, the rib portions 19 may protrude to the side opposite to the electron emission surface 13 and the length of protrusion is not limited.

In the second embodiment, the rib portions 19 may be formed of a material different from the base portion 15.

In the first to third embodiments, the electron emission surface 13 is not limited to a flat surface but may be a surface having an arbitrary curvature.

In the first to third embodiments, at least one slit 21 may be provided and the number of slits 21 is not limited, and the shape of the slit 21 is not limited to a linear shape but may be a curved shape or an oblique shape.

The X-ray tube 1 is not limited to the rotary anode type X-ray tube but may be a stationary anode type X-ray tube. In addition, if the emitter 11 is available as the electron emission source, the emitter 11 is not limited to an X-ray tube 1 but may be an emitter 11 available for the other electronic devices.

What is claimed is:

1. An emitter, comprising:

a base portion including an electron emission surface from which electrons are emitted;

a pair of leg portions applying a voltage to the electron emission surface;

a rib portion formed by bending an edge of the base portion to a side opposite to the electron emission surface, on at least a part of an outline of the electron emission surface; and a slit for forming a current path on the electron emission surface formed at the base portion, wherein the slit is formed along the rib portion to divide the rib portion into rib portions.

2. The emitter of claim 1, wherein the pair of leg portions are provided at opposed portions at the outline of the electron emission surface, the rib portions are provided at right and left parts between the pair of leg portions, and the slits are alternately formed on right and left sides between the pair of leg portions.

3. The emitter of claim 1, further comprising through holes formed on the electron emission surface.

4. The emitter of claim 3, wherein the through holes are formed at positions close to the rib portions.

5. The emitter of claim 1, wherein the an outline of the electron emission surface is formed in a rectangular shape, the pair of leg portions are provided on two opposed rectangular sides, and the rib portions are provided on two other sides.

6. An X-ray tube, comprising:

a vacuum envelope;

a cathode provided in the vacuum envelope to emit electrons, the cathode comprising an emitter, the emitter comprising a base portion including an electron emission surface from which electrons are emitted, a pair of leg portions applying a voltage to the electron emission surface, a rib portion formed by bending an edge of the base portion to a side opposite to the electron emission surface, on at least a part of an outline of the electron emission surface, and a slit for forming a current path on the electron emission surface formed at the base portion, wherein the slit is formed along the rib portion to divide the rib portion; and an anode provided in the vacuum envelope, allowing the electrons emitted from the cathode to collide and generating X rays.

7. An emitter, comprising:

a base portion including an electron emission surface from which electrons are emitted;

a pair of leg portions applying a voltage to the electron emission surface;

a rib portion protruding from the base portion toward a side surface opposite to the electron emission surface, on at least a part of an outline of the electron emission surface; and a slit for forming a current path on the electron emission surface formed at the base portion, wherein the slit is formed along the rib portion to divide the rib portion into rib portions.

8. The emitter of claim 7, wherein the pair of leg portions are provided at opposed portions at the outline of the electron emission surface, the rib portions are provided at right and left parts between the pair of leg portions, and the slits are alternately formed on right and left sides between the pair of leg portions.

9. The emitter of claim 7, further comprising through holes formed on the electron emission surface.

10. The emitter of claim 9, wherein the through holes are formed at positions close to the rib portions.

11. The emitter of claim 7, wherein an outline of the electron emission surface is formed in a rectangular shape, the pair of leg portions are provided on two opposed rectangular sides, and the rib portions are provided on two other sides.

12. An X-ray tube, comprising:

a vacuum envelope;

a cathode provided in the vacuum envelope to emit electrons, the cathode comprising an emitter, the emitter comprising a base portion including an electron emission surface from which electrons are emitted, a pair of leg portions applying a voltage to the electron emission surface, a rib portion protruding from the base portion toward a side surface opposite to the electron emission surface, on at least a part of an outline of the electron emission surface, and a slit for forming a current path on the electron emission surface formed at the base portion, wherein the slit is formed along the rib portion to divide the rib portion; and an anode provided in the vacuum envelope, allowing the electrons emitted from the cathode to collide and generating X rays.

* * * * *